US007642722B2

(12) United States Patent
Schoeller et al.

(10) Patent No.: US 7,642,722 B2
(45) Date of Patent: Jan. 5, 2010

(54) HIGH-PRESSURE DISCHARGE LAMP WITH IMPROVED COLOR POINT STABILITY AND HIGH LUMINOUS EFFICACY

(75) Inventors: Klaus Schoeller, Nideggen (DE); Rolf Gervelmeyer, Geilenkirchen (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 287 days.

(21) Appl. No.: 10/527,007

(22) PCT Filed: Aug. 29, 2003

(86) PCT No.: PCT/IB03/03851

§ 371 (c)(1),
(2), (4) Date: Mar. 7, 2005

(87) PCT Pub. No.: WO2004/025691

PCT Pub. Date: Mar. 25, 2004

(65) Prior Publication Data

US 2005/0253528 A1 Nov. 17, 2005

(30) Foreign Application Priority Data

Sep. 10, 2002 (DE) ..... 102 42 203

(51) Int. Cl.
*H01J 17/00* (2006.01)
*H01J 17/20* (2006.01)
*H01J 61/12* (2006.01)
*H01J 61/18* (2006.01)

(52) U.S. Cl. ..... 313/640; 313/567; 313/634; 313/635; 313/636; 313/637; 313/638; 313/639; 313/641

(58) Field of Classification Search ..... 313/637, 313/639–640
See application file for complete search history.

(56) References Cited

U.S. PATENT DOCUMENTS

| | | | | |
|---|---|---|---|---|
| 4,047,069 | A * | 9/1977 | Akutsu et al. | 313/487 |
| 5,572,091 | A * | 11/1996 | Langer et al. | 313/636 |
| 5,961,208 | A * | 10/1999 | Karpen | 313/112 |
| 6,376,988 | B1 * | 4/2002 | Mukai et al. | 313/641 |
| 6,608,444 | B2 * | 8/2003 | Minamihata et al. | 315/56 |
| 6,653,801 | B1 * | 11/2003 | Takeda et al. | 315/246 |
| 6,670,765 | B2 * | 12/2003 | Muto | 313/641 |
| 2004/0150344 | A1 * | 8/2004 | Takagaki et al. | 313/634 |

FOREIGN PATENT DOCUMENTS

EP 0 964 431 A3 12/1999

(Continued)

*Primary Examiner*—Nimeshkumar D. Patel
*Assistant Examiner*—Natalie K Walford

(57) ABSTRACT

A high-pressure discharge lamp which is suitable for motor vehicle headlights, has an improved color point stability close to the black body locus, a high color temperature, and a high luminous efficacy (lm/w). The high-pressure discharge lamp includes an inner vessel with a discharge chamber, with at least two electrodes extending into the discharge chamber, and an outer bulb surrounding the inner vessel. The discharge chamber contains an ionizable filling including at least one rare gas, 0-10 mg of mercury, and a metal halide mixture. The metal halide mixture includes 40-80% by weight of sodium halide, 25-55% by weight of scandium halide, 1-15% by weight of indium halide, and 0-34% by weight of thallium halide.

16 Claims, 2 Drawing Sheets

FOREIGN PATENT DOCUMENTS

Figure 1:
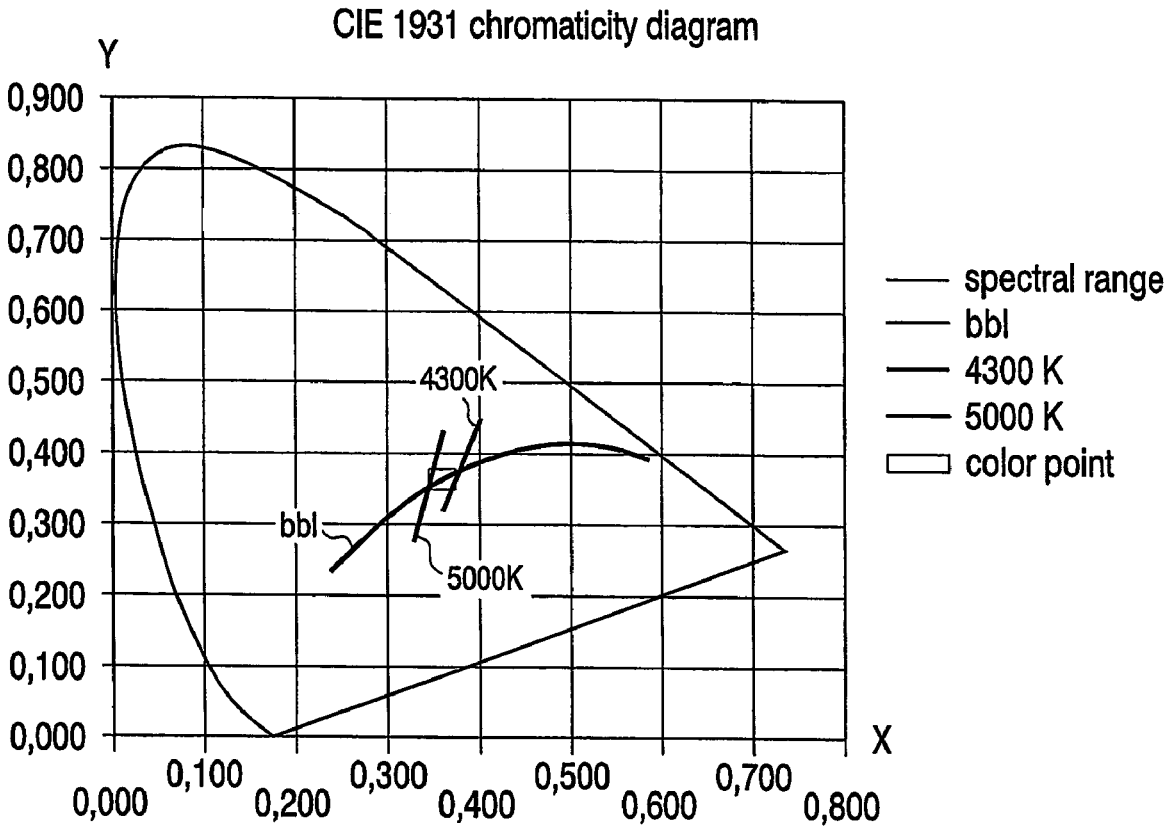

| | | | |
|---|---|---|---|
| EP | 1 037 257 | A2 | 9/2000 |
| EP | 1158567 | A2 | 11/2001 |
| EP | 1158567 | A3 | 1/2002 |
| EP | 1288998 | A1 | 3/2003 |
| EP | 1349197 | A2 | 10/2003 |

* cited by examiner

HIGH-PRESSURE DISCHARGE LAMP WITH IMPROVED COLOR POINT STABILITY AND HIGH LUMINOUS EFFICACY

The present invention relates to a high-pressure discharge lamp comprising an inner vessel with a discharge chamber, at least two electrodes extending into said discharge chamber, and possibly an outer bulb surrounding the inner vessel, said discharge chamber having an ionizable filling. This high-pressure discharge lamp with and without outer bulb is suitable for general lighting purposes. The use of the high-pressure discharge lamp is suitable in particular for forward illumination of a vehicle such as, for example, an automobile.

A discharge lamp of the kind described above with an inner vessel and outer bulb is known from EP-A3 0 964 431. The discharge lamp described therein comprises a light arc tube comprising a light-emitting region which is provided with a pair of electrodes, and an outer tube which surrounds the light-emitting region and is at least partly fused to the light arc tube, said outer tube comprising silicon dioxide as its main ingredient and in addition boron.

A mercury-free metal halide lamp is known from EP-A2 1 037 257 which contains 0.2 mg(=36.4% by weight) of indium iodide ($InI_3$), 0.19 mg(=34.5% by weight) of scandium iodide, and 0.16 mg(=29.1% by weight) of sodium iodide. This corresponds to a metal halide content of 550 μg. It was found that a metal halide content of 550 μg may lead to visible deposits in the inner vessel, i.e. in the burner space.

It is a particular disadvantage in discharge lamps known from the present art that the color point of the emitted light is not close to the black body locus in accordance with the CIE 1931 diagram, i.e. not close to the line representing the radiation of a black body, while at the same time the color temperature lies in a range of 4300 K to 5000 K. In addition, the discharge lamps known from the prior art often have a bad luminous efficacy (lm/W), insufficient lamp life properties, and in particular an insufficient color point stability.

It is an object of the present invention to provide a high-pressure discharge lamp with an increased color temperature of the emitted light, also indicated as lines of equal color temperature or correlated color temperature (CCT), wherein the color point of the emitted light in accordance with the CIE 1931 diagram lies close to the black body locus, while the high-pressure discharge lamp has improved lamp life properties, and in particular an improved color point stability.

A further object of the present invention is to provide a high-pressure discharge lamp which in addition has an ionizable filling which is environmentally friendly.

A suitable high-pressure discharge lamp according to the invention comprises an inner vessel with a discharge chamber, with at least two electrodes extending into the discharge chamber, and possibly an outer bulb surrounding the inner vessel, wherein the discharge chamber contains an ionizable filling comprising:

at least one rare gas,
0 mg to 10 mg of mercury, and
a metal halide mixture comprising:
40 to 80% by weight of sodium halide,
25 to 55% by weight of scandium halide,
1 to 15% by weight of indium halide, and
0 to 34% by weight of thallium halide.

The surprising advantageous properties such as an improved color point stability, high luminous efficacy, and color temperature are a result of the ionizable filling according to the invention.

The percentages by weight indicated for the various metal halides, such as di- or triiodide, mono-, di-, or trichloride, and mono-, di-, or tribromide, with the exception of scandium halide, relate (unless indicated to the contrary) to the corresponding metal monoiodide, i.e. NaI, InI, or TlI, as part of the total weight of the metal halide mixture, in relation to the corresponding iodide, i.e. NaI, InI, $ScI_3$, and TlI, of the ionizable filling. The indicated percentage by weight of scandium halide, unless indicated to the contrary, relates to $ScI_3$ as part of the total weight of the metal halide mixture, i.e. NaI, InI, $ScI_3$, and TlI with respect to the corresponding iodide, of the ionizable filling. The conversion for metal halide compounds to the respective metal monoiodide compound takes place by means of the molar masses of the respective compounds for which the molecular number of the metal is the same. Accordingly, for example, 20.5% by weight of $InI_3$ corresponds by conversion to 10% by weight of InI. This results from the following conversion:

molar mass of InI=241.72 g/mole
molar mass Of $InI_3$=495.53 g/mole
(20.5% $InI_3$×241.72 g/mole InI)÷495.53 g/mole $InI_3$=10% InI by weight.

The proportions in percents by weight of the respective metal halides in relation to the corresponding metal iodide, i.e. NaI, InI, $ScI_3$, and TlI, of the ionizable filling is chosen such that the total metal halide weight proportion converted to iodide is not more than 100% by weight.

Preferred metal halides are metal iodide and/or metal bromide. Metal iodide is particularly preferred.

Preferred metal iodides are chosen from the group comprising NaI, $ScI_3$, InI, $InI_3$, and/or TlI.

Indium iodide may be present as InI and/or $InI_3$, with InI being particularly preferred. Preferably, the total content of the metal halide mixture in the ionizable filling calculated as metal iodide, i.e. NaI, $ScI_3$, InI, and TlI, amounts to ≦500 μg, preferably ≦450 μg, and particularly preferably ≦400 μg. The total content of metal halide mixture in the ionizable filling calculated on the basis of metal iodide, i.e. NaI, $SCI_3$, InI, and TII, may also be ≦350 μg, preferably ≦300 μg, and particularly preferably ≧250 μg and ≦320 μg.

The high-pressure discharge lamp according to the invention has a higher color temperature than conventional high-pressure discharge lamps known from the prior art, which color point lies closer to the black body locus. The color temperature, i.e. the line of equal color temperatures or correlated color temperature, of the light emitted by the high-pressure discharge lamp lies in a range from 4300 K and 5000 K, preferably 4500 K to 4900 K, more preferably 4700 K to 4800 K.

A higher color temperature gives the driver of a vehicle a better view, in particular at night. Furthermore, the higher color temperature and the color point close to the black body locus leads to a better reflection of the light emitted by the high-pressure discharge lamp according to the invention, in particular against driving lane markings and traffic signs. This leads to a higher traffic safety. It should also be noted that the ionizable filling according to the invention of the high-pressure discharge lamp emits a light that is more similar to daylight. This daylight-type light is not fatiguing to the eyes.

The high-pressure discharge lamp according to the invention, furthermore, has improved lamp life properties, in particular an enhanced color point stability. It is a major disadvantage that the color point of the emitted light of high-pressure discharge lamps of the prior art shows a significant shift over lamp life, so that a visible color change of the emitted light of such high-pressure discharge lamps is observed. This is particularly disadvantageous in the case of motor vehicles because this may result in the light color of the high-pressure discharge lamps contained in headlights being different in the case of an exchange of only one high-pressure discharge lamp. This disadvantage is eliminated by the high-pressure discharge-lamp according to the invention.

Thus the color point change of the emitted light of the high-pressure discharge lamp according to the invention with respect to the X-color coordinate and the Y-color coordinate amounts to ≦6%, preferably ≦5%, preferably ≦4%, more preferably ≦3%, particularly preferably ≦2%, and most preferably ≦1% over a period of operation of the high-pressure discharge lamp of 1500 hours.

It was found to be advantageous if the color point of the light emitted by the high-pressure discharge lamp in the CIE 1931 diagram has an X-color coordinate in a range from 0.345 to 0.375, preferably from 0.350 to 0.370, more preferably from 0.355 to 0.360, and a Y-color coordinate in a range from 0.350 to 0.375, preferably from 0.355 to 0.370, more preferably from 0.360 to 0.365.

It was surprisingly found, furthermore, that the use of a mercury-containing or mercury-free ionizable filling comprising at least sodium iodide, scandium iodide, and indium iodide as metal halides renders it possible not only to achieve the envisaged color temperature and color point, but also a luminous efficacy of at least 70 lm/W.

In addition, a good luminous efficacy (lm/W) can be achieved with the ionizable filling according to the invention. Thus the luminous efficacy of the light emitted by a high-pressure discharge lamp according to the invention amounts to at least 70 lm/W, preferably ≧75 lm/W, more preferably ≧95 lm/W. Indeed, luminous efficacies of ≧100 lm/W and more can be achieved by the high-pressure discharge lamps according to the invention.

In a preferred embodiment of the present invention, the luminous efficacy of the light emitted by the high-pressure discharge lamp is ≧80 lm/W, preferably ≧90 lm/W.

The use of neodymium or neodymium oxide makes it possible to increase the color temperature with an otherwise unchanged salt composition, such that a shift towards a bluer light in combination with a high luminous efficacy of at least 70 lm/W is achievable.

It was further found in accordance with the invention that the color point described above as well as the desired lm/W efficacy can be achieved also without the addition of thallium iodide, i.e. with the use of a salt composition of sodium iodide, scandium iodide, and indium iodide. This is particularly advantageous because thallium iodide is highly detrimental to the environment.

A particularly environmentally friendly high-pressure discharge lamp can be obtained when a mercury-free ionizable filling is used with a salt composition comprising sodium iodide, scandium iodide, and indium iodide.

In a further preferred embodiment of the invention, the outer bulb comprises neodymium, preferably neodymium oxide and cerium, preferably cerium oxide. Particularly advantageous is an outer bulb glass of quartz glass doped with neodymium, for example neodymium oxide and cerium, for example cerium oxide.

The addition of cerium or cerium oxide serves in particular as a UV protection.

Unless indicated otherwise, weight indications for neodymium or neodymium compounds, preferably neodymium oxide, are given on the basis of neodymium oxide $Nd_2O_3$ in relation to the total weight of the outer bulb. Weight indications for cerium or cerium compounds, preferably cerium oxide, are given on the basis of cerium oxide $CeO_2$, in relation to the total weight of the outer bulb.

The neodymium or neodymium compound content, in particular neodymium oxide, accounts for 2 to 20% by weight related to the total weight of the outer bulb. The weight content of the cerium, preferably cerium oxide, is preferably 0.1 to 3% by weight with respect to the total weight of the outer bulb. The outer bulb is preferably made of quartz glass.

In a preferred embodiment of the high-pressure discharge lamp according to the invention, the ionizable filling comprises at least one rare gas, preferably xenon, 50 to 70% by weight of sodium iodide, 30 to 50% by weight of scandium iodide, 1 to 15% by weight of indium iodide, and 0 mg to 10 mg mercury.

Unless indicated otherwise, the percentage by weight indication relates to the respective metal iodide NaI, $ScI_3$, InI, and TlI. This means, for example, that with the use of $InI_3$ in the metal halide mixture the actual content of $InI_3$ is converted back to InI and may thus also be more than 15% by weight.

In a further preferred embodiment of the invention, the ionizable filling of a high-pressure discharge lamp according to the invention comprises at least one rare gas, preferably xenon, 50 to 60% by weight of sodium iodide, 35 to 45% by weight of scandium iodide, 1 to 15% by weight of indium iodide, and 0 mg to 10 mg mercury.

Preferably, the ionizable filling is composed of xenon, sodium iodide, scandium iodide, indium iodide, and mercury.

The mercury content of the ionizable filling is ≧0 mg and ≦10 mg, said mercury content preferably being ≦5 mg, more preferably ≦1 mg, and particularly preferably ≦0.6 mg. The mercury content of the ionizable filling may also be ≧0.5 mg and ≦0.6 mg.

Preferably, the ionizable filling of the high-pressure discharge lamp is free from mercury and is composed of xenon, sodium iodide, scandium iodide, and indium iodide.

In an even more preferred embodiment of the invention, the mercury-containing high-pressure discharge lamp contains 40% by weight of sodium iodide, 50% by weight of scandium iodide, and 10% by weight of indium iodide, preferably InI.

InI and/or $InI_3$ are suitable as indium iodides, with InI being preferred. For example, a content of 3% to 5% by weight of indium iodide may be used. Alternatively, ≧1% and ≦2.5% by weight may be used.

In said even more preferred embodiment, the mercury-containing high-pressure discharge lamp contains an ionizable filling comprising 45% by weight of sodium iodide, 50% by weight of scandium iodide, and 5% by weight of indium iodide (InI and/or $InI_3$).

In a particularly preferred embodiment, the high-pressure discharge lamp contains an ionizable filling comprising 550 μg Hg, 50% by weight of NaI, 45% by weight of $ScI_3$, and 5% by weight of InI.

The ionizable filling may in addition comprise zinc halide, preferably zinc iodide. The ionizable filling of mercury-free high-pressure discharge lamps according to the invention preferably comprises zinc halide, in particular $ZnI_2$.

Lamp life is at least 1500 hours, preferably ≧2500 hours, most preferably ≧3000 hours for a high-pressure discharge lamp according to the invention.

Figure 2:
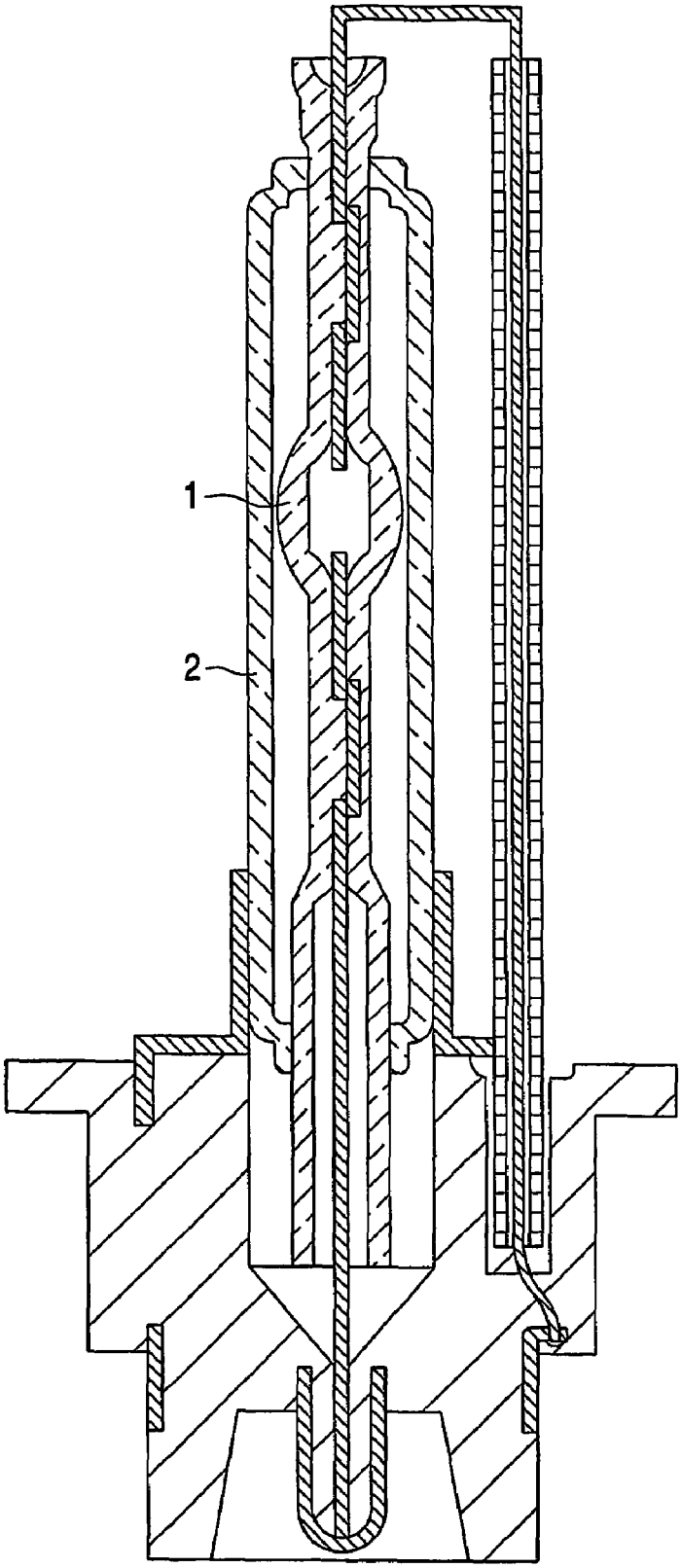

The substance of the present patent application will be explained in more detail below with reference to the Figures, in which FIG. 1 shows a CIE 1931 chromaticity diagram, and FIG. 2 shows a usual high-pressure discharge lamp with an inner vessel and an outer bulb.

The diagram of FIG. 1 shows the line of radiation of a black body, denoted black body locus (bbl) within the spectral range. The color temperature, i.e. lines of equal color temperature, also denoted correlated color temperature, of 4300 K and 5000 K lie at corner points of the color point range of the ionizable metal halide filling according to the invention, which was drawn in the diagram as a surface area. As is apparent from the diagram, the color point of the high-pressure lamp according to the invention lies close to the black body locus.

FIG. 2 shows a usual high-pressure discharge lamp with an inner vessel (1) and an outer bulb (2).

The high-pressure discharge lamp according to the invention may be used for general lighting purposes. In particular, the high-pressure discharge lamp may be used as a light source, for example in means of transport such as airplanes, motor vehicles, motorcycles, and the like. The use of the high-pressure discharge lamp according to the invention is particularly preferred in headlights, in particular front illumination headlights of motor vehicles such as automobiles.

The invention claimed is:

1. A high-pressure discharge lamp comprising:

an inner vessel with a discharge chamber, and with at least two electrodes extending into the discharge chamber, wherein the discharge chamber contains an ionizable filling comprising:

at least one rare gas, 0 mg to 10 mg of mercury, and a metal halide mixture comprising:

40 to 80% by weight of sodium halide, 25 to 55% by weight of scandium halide, 1 to 15% by weight of indium halide, and 0 to 34% by weight of thallium halide;

wherein total content of the metal halide mixture in the ionizable filling calculated as metal iodide amounts to <350 μg.

2. The high-pressure discharge lamp as claimed in claim 1, wherein a color point of light emitted by the high-pressure discharge lamp in a CIE 1931 diagram has an X-color coordinate in a range from 0.345 to 0.375, and a Y-color coordinate in a range from 0.350 to 0.375.

3. The high-pressure discharge lamp as claimed in claim 1, wherein a color temperature of light emitted by the high-pressure discharge lamp lies in a range from 4300 K to 5000 K.

4. The high-pressure discharge lamp as claimed in claim 1, wherein luminous efficacy of light emitted by the high-pressure discharge lamp is at least 70 lm/W.

5. The high-pressure discharge lamp as claimed in claim 1, wherein a color point change with respect to an X-color coordinate and a Y-color coordinate in a CIE 1931 diagram amounts to ≦6% over a period of operation of the high-pressure discharge lamp of 1500 hours.

6. The high-pressure discharge lamp as claimed in claim 1, wherein the at least one rare gas includes xenon, and the ionizable filling further comprises:

50 to 70% by weight of sodium iodide, 30 to 50% by weight of scandium iodide, 1 to 15% by weight of indium iodide, and 0 to 10 mg mercury.

7. The high-pressure discharge lamp as claimed in claim 1, wherein the at least one rare gas includes xenon, and the ionizable filling comprises:

50 to 60% by weight of sodium iodide, 35 to 45% by weight of scandium iodide, 1 to 15% by weight of indium iodide, and 0 to 10 mg mercury.

8. A lighting unit comprising the high-pressure discharge lamp as claimed in claim 1.

9. The high-pressure discharge lamp of claim 1, wherein a color point of light emitted by the high-pressure discharge lamp in a CIE 1931 diagram has an X-color coordinate in a range from 0.350 to 0.370, and a Y-color coordinate in a range from 0.355 to 0.370.

10. The high-pressure discharge lamp of claim 1, wherein a color point of light emitted by the high-pressure discharge lamp in a CIE 1931 diagram has an X-color coordinate in a range from 0.355 to 0.360, and a Y-color coordinate in a range from 0.350 to 0.375.

11. The high-pressure discharge lamp of claim 1, wherein a color temperature of light emitted by the high-pressure discharge lamp lies in a range from 4700 K to 4800 K.

12. The high-pressure discharge lamp of claim 1, wherein luminous efficacy of light emitted by the high-pressure discharge lamp is at least ≧75 lm/W.

13. The high-pressure discharge lamp of claim 1, wherein a color point change with respect to an X-color coordinate and a Y-color coordinate in a CIE 1931 diagram amounts to ≦5% over a period of operation of the high-pressure discharge lamp of 1500 hours.

14. The high-pressure discharge lamp of claim 1, wherein the percentages by weight for the metal halides, with the exception of scandium halide, relate to corresponding metal mono-halide as part of the total weight of the metal halide mixture, in relation to the corresponding mono-halide of the ionizable filling.

15. A lamp comprising:

an inner vessel including an ionizable filling; and an outer bulb surrounding the inner vessel;

the ionizable filling comprising:

at least one rare gas, 0 mg to 10 mg of mercury, and a metal halide mixture comprising:

40 to 80% by weight of sodium halide, 25 to 55% by weight of scandium halide, 1 to 15% by weight of indium halide, and 0 to 34% by weight of thallium halide;

wherein total content of the metal halide mixture in the ionizable filling calculated as metal iodide amounts to <350 μg.

16. The lamp of claim 15, wherein the percentages by weight for the metal halides, with the exception of scandium halide, relate to corresponding metal mono-halide as part of the total weight of the metal halide mixture, in relation to the corresponding mono-halide of the ionizable filling.

* * * * *